US011988229B2

(12) United States Patent
Kisun et al.

(10) Patent No.: US 11,988,229 B2
(45) Date of Patent: May 21, 2024

(54) DIFFUSER PIPE ALIGNMENT TOOL

(71) Applicant: PRATT & WHITNEY CANADA CORP., Longueuil (CA)

(72) Inventors: Gavin Rohiteshwar Kisun, Oakville (CA); Danny Noiseux, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/331,276

(22) Filed: Jun. 8, 2023

(65) Prior Publication Data

US 2023/0313814 A1 Oct. 5, 2023

Related U.S. Application Data

(62) Division of application No. 17/557,967, filed on Dec. 21, 2021, now Pat. No. 11,708,844.

(51) Int. Cl.
*F04D 29/60* (2006.01)
*F04D 29/44* (2006.01)

(52) U.S. Cl.
CPC ..... *F04D 29/601* (2013.01); *F04D 29/441* (2013.01)

(58) Field of Classification Search
CPC .... F04D 29/601; F04D 29/441; F04D 29/624; F04D 17/10; F01D 25/285
See application file for complete search history.

(56) References Cited

U.S. PATENT DOCUMENTS

| | | | | |
|---|---|---|---|---|
| 4,115,048 | A | 9/1978 | Alderferer et al. | |
| 5,131,142 | A | 7/1992 | Brasz | |
| 5,252,027 | A | 10/1993 | Brasz | |
| 7,442,006 | B2 | 10/2008 | Nguyen et al. | |
| 8,528,176 | B2 | 9/2013 | Macchia et al. | |
| 9,133,858 | B2 * | 9/2015 | Macchia | F04D 1/14 |
| 9,441,498 | B2 * | 9/2016 | Edwards | F01D 25/265 |
| 9,469,406 | B2 | 10/2016 | Beers et al. | |
| 9,745,999 | B2 | 8/2017 | Beers et al. | |
| 2010/0101065 | A1 | 4/2010 | Macchia et al. | |
| 2013/0276285 | A1 * | 10/2013 | Macchia | F04D 1/14 29/426.5 |
| 2015/0115534 | A1 * | 4/2015 | Edwards | B25B 27/0028 277/301 |
| 2021/0172455 | A1 | 6/2021 | Kisun et al. | |

* cited by examiner

*Primary Examiner* — Lawrence Averick
(74) *Attorney, Agent, or Firm* — NORTON ROSE FULBRIGHT CANADA LLP

(57) ABSTRACT

A method of positioning exits of diffuser pipes of a centrifugal compressor in an aircraft engine includes aligning an alignment tool with a structure supporting the diffuser pipes, and rotating each diffuser pipe about an inlet axis thereof to close a gap between a surface of the diffuser pipe and part of the alignment tool until the diffuser pipe abuts the part of the alignment tool. The alignment tool includes for example a body defining a center axis and having at least one tool datum configured for abutting against the casing, and a plurality of alignment members that are fixed to the body and extend radially from the body relative to the center axis.

12 Claims, 6 Drawing Sheets

DIFFUSER PIPE ALIGNMENT TOOL

CROSS-REFERENCE TO RELATED APPLICATIONS

The present application is a divisional of U.S. patent application Ser. No. 17/557,967 filed Dec. 21, 2021, the entire content of which is incorporated herein by reference.

TECHNICAL FIELD

The application relates generally to centrifugal compressors of aircraft engines and, more particularly, to diffuser pipes of such centrifugal compressors.

BACKGROUND

Certain centrifugal compressors use diffuser pipes for diffusing high speed airflow received from an impeller of the centrifugal compressor and directing the airflow to an engine component downstream of the compressor, such as the combustor or another compression stage. Diffuser pipes are typically circumferentially arranged at a periphery of the impeller exit, and are designed to transform kinetic energy of the flow into pressure energy. As the diffused air exiting the diffuser pipes may impinge on the downstream combustor, any misalignment of the diffuser pipes during assembly of the engine may result in the combustor being exposed to discrete and inconsistent thermal patterns.

SUMMARY

There is disclosed an alignment tool for aligning a plurality of diffuser pipes of a centrifugal compressor relative to a casing of an aircraft engine, the alignment tool comprising: a body defining a center axis and having at least one tool datum configured for abutting against the casing; and a plurality of alignment members fixed to the body and extending radially from the body relative to the center axis, each alignment member of the plurality of alignment members having a respective fixed position relative to the at least one tool datum, the plurality of alignment members configured to abut the plurality of diffuser pipes.

In embodiments, the alignment tool includes one or more of the following features, in any combination:

The body is annular, the plurality of alignment members circumferentially spaced apart and fixed to the body, a portion of each alignment member extending radially inwardly from the body toward the center axis of the alignment tool.

The body is annular about the center axis, the plurality of alignment members circumferentially spaced apart and fixed to the body, each alignment member configured to be positioned circumferentially between two diffuser pipes of the plurality of diffuser pipes.

The body includes a support being annular about the center axis, the plurality of alignment members circumferentially spaced apart and mounted to the support.

The support is a mesh having a plurality of slots spaced circumferentially apart, the plurality of alignment members disposed in the plurality of slots.

The plurality of alignment members are elongated cylindrical bodies.

The at least one tool datum comprises: an axial datum defining a radially-extending surface configured to abut the casing; a radial datum defining an axially-extending surface configured to abut the casing; and a circumferential datum configured to abut the casing.

The circumferential datum is removably mountable to the casing.

There is disclosed a method of positioning exits of diffuser pipes of a centrifugal compressor in an aircraft engine, the method comprising: aligning an alignment tool with a structure supporting the diffuser pipes; and rotating each diffuser pipe about an inlet axis thereof to close a gap between a surface of the diffuser pipe and part of the alignment tool until the diffuser pipe abuts the part of the alignment tool.

In embodiments, the method includes one or more of the following features, in any combination:

Rotating each diffuser pipe includes rotating each diffuser pipe to abut an exit segment against the part of the alignment tool, the exits of the abutted diffuser pipes having uniform orientations.

Rotating each diffuser pipe includes rotating each diffuser pipe one at a time.

Fixing each diffuser pipe in position after abutting each diffuser pipe against the part of the alignment tool.

Removing the alignment tool from the structure.

Mounting the diffuser pipes to the support structure before aligning the alignment tool with the structure.

Rotating each diffuser pipe includes rotating each diffuser pipe to abut the diffuser pipe against the part of the alignment tool and to provide exit segments of the diffuser pipes with uniform orientations relative to a downstream combustor.

Mounting the diffuser pipes to the support structure before aligning the alignment tool with the structure, wherein aligning the alignment tool with the structure includes lowering the alignment tool against the support structure.

Aligning the alignment tool with the structure includes abutting the alignment tool and the structure along at least one common datum.

Abutting the alignment tool and the structure along at least one common datum includes abutting the alignment tool and the structure together to prevent relative movement along at least one of an axial direction, a radial direction, and a circumferential direction.

Aligning the alignment tool with the structure includes mounting the alignment tool to the structure along at least one common datum.

Rotating each diffuser pipe includes rotating each diffuser pipe to abut the diffuser pipe against the part of the alignment tool along a line of contact.

There is also disclosed an assembly of an alignment tool and of a casing having a plurality of diffuser pipes, the assembly aligned along at least one datum, the assembly comprising: a plurality of alignment members of the alignment tool, each alignment member of the plurality of alignment members having a fixed position relative to the at least one datum and having a portion extending radially toward a center axis of the alignment tool; and each diffuser pipe of the plurality of diffuser pipes extending radially from a pipe inlet to a pipe exit, each diffuser pipe abutting against the portion of each alignment member.

In embodiments, the assembly includes one or more of the following features, in any combination:

The body is annular, the plurality of alignment members circumferentially spaced apart and fixed to the body, a portion of each alignment member extending radially inwardly from the body toward the center axis of the alignment tool.

The body is annular about the center axis, the plurality of alignment members circumferentially spaced apart and fixed to the body, each alignment member configured to be positioned circumferentially between two diffuser pipes of the plurality of diffuser pipes.

The body includes a support being annular about the center axis, the plurality of alignment members circumferentially spaced apart and mounted to the support.

The support is a mesh having a plurality of slots spaced circumferentially apart, the plurality of alignment members disposed in the plurality of slots.

The plurality of alignment members are elongated cylindrical bodies.

The at least one tool datum comprises: an axial datum defining a radially-extending surface configured to abut the casing; a radial datum defining an axially-extending surface configured to abut the casing; and a circumferential datum configured to abut the casing.

The circumferential datum is removably mountable to the casing.

BRIEF DESCRIPTION OF THE DRAWINGS

Reference is now made to the accompanying figures in which.

DETAILED DESCRIPTION

Figure 1:
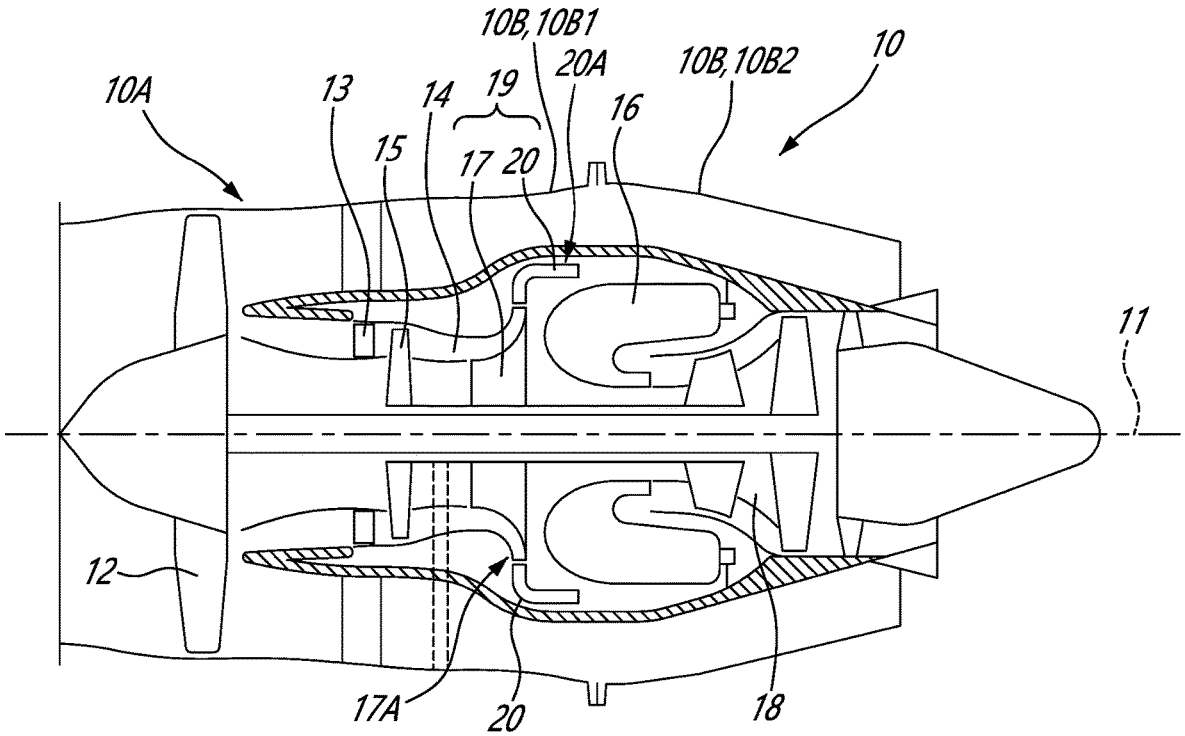
FIG. 1 is a schematic cross sectional view of a gas turbine engine.

FIG. 1 illustrates an aircraft engine 10 of a type preferably provided for use in subsonic flight, such as a gas turbine engine, generally comprising in serial flow communication along an engine center axis 11 a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The compressor section 14 may include a plurality of stators 13 and rotors 15 (only one stator 13 and rotor 15 being shown in FIG. 1), and it may include a centrifugal compressor 19.

The centrifugal compressor 19 of the compressor section 14 includes a rotatable impeller 17 with blades, and a plurality of diffuser pipes 20 which are located downstream of the impeller 17 and circumferentially disposed about a periphery of a radial outlet 17A of the impeller 17. The diffuser pipes 20 convert high kinetic energy at the impeller 17 exit to static pressure by slowing down fluid flow exiting the impeller. The diffuser pipes 20 may also redirect the air flow from a radial orientation to an axial orientation (i.e. aligned with the center axis 11). The diffuser pipes 20 are thus part of a compressor diffuser 20A. In most cases, the Mach number of the flow entering the diffuser pipe 20 may be at or near sonic, while the Mach number exiting the diffuser pipe 20 may be less than 0.25 to enable stable air/fuel mixing, and light/re-light in the combustor 16.

The impeller 17 and the diffuser pipes 20 are housed within part of an engine casing 10A. In an embodiment, the engine casing 10A (sometimes referred to herein simply as the "the casing 10A") may be an integral and annular body extending along the center axis 11. Referring to FIG. 1, the casing 10A is composed of interconnected casing segments 10B, sometimes referred to as "cases" or "shrouds". The impeller 17 and the diffuser pipes 20 are housed within one of the casing segments 10B. In the configuration of the engine casing 10A shown in FIG. 1, the casing segment 10B in which the impeller 17 and the diffuser pipes 20 are housed is a gas generator casing segment 10B1. The impeller 17 and the diffuser pipes 20 may be housed in a different casing segment 10B. In the configuration of the engine casing 10A shown in FIG. 1, another casing segment 10B is the turbine support casing segment 10B2 which is mounted to the gas generator casing segment 10B1 along mated flanges. The turbine support casing segment 10B2 includes the combustor 16 and components of the turbine section 18, and is positioned downstream of the gas generator casing segment 10B1 so that the air exiting the diffuser pipes 20 flows toward the combustor 16.

Figure 2:
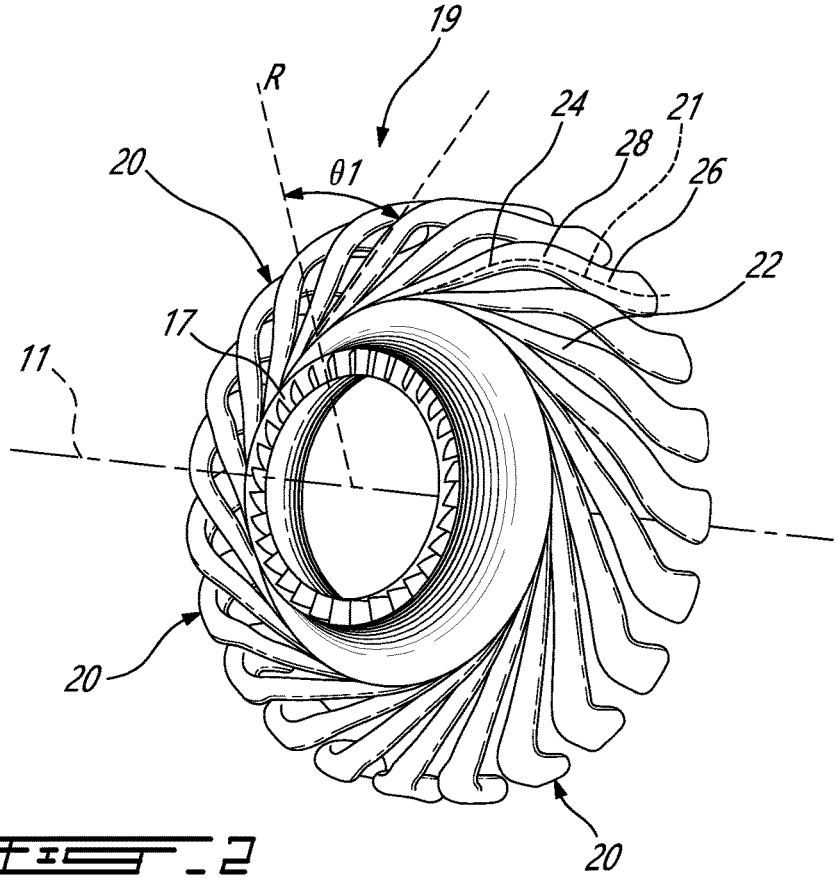
FIG. 2 is a perspective view of a centrifugal compressor of the gas turbine of FIG. 1, the centrifugal compressor including an impeller and diffuser pipes.

FIG. 2 shows the impeller 17 and the plurality of diffuser pipes 20, also referred to as "fishtail diffuser pipes", of the centrifugal compressor 19. Each of the diffuser pipes 20 includes a diverging (in a downstream direction) tubular body 22, formed, in one embodiment, of sheet metal. The enclosed tubular body 22 defines a flow passage 29 (see FIG. 3) extending through the diffuser pipe 20 through which the compressed fluid flow is conveyed. The tubular body 22 includes a first portion 24 extending generally tangentially from the periphery and radial outlet 17A of the impeller 17. An open end is provided at an upstream end of the tubular body 22 and forms an inlet 23 (see FIG. 3) of the diffuser pipe 20. The first portion 24 is inclined at an angle 81 relative to a radial axis R extending from the engine axis 11. The angle 81 may be at least partially tangential, or even substantially tangentially, and may further correspond to a direction of fluid flow at the exit of the blades of the impeller 17, such as to facilitate transition of the flow from the impeller 17 to the diffuser pipes 20. The first portion 24 of the tubular body 22 can alternatively extend more substantially along the radial axis R.

Figure 3:
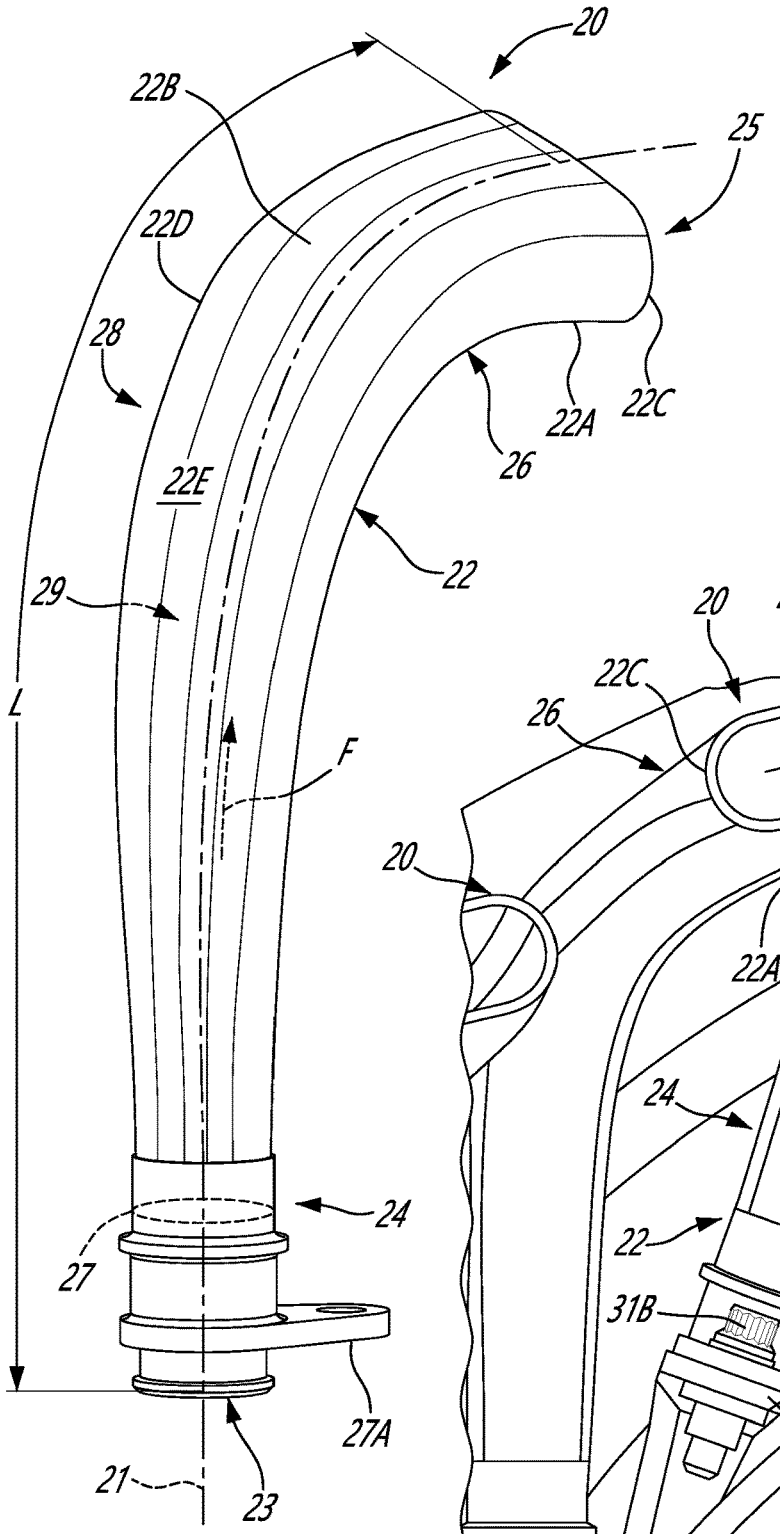
FIG. 3 is a perspective view of one of the diffuser pipes of FIG. 2.

The tubular body 22 of the diffuser pipes 20 also includes a second portion 26, which is disposed generally axially relative to the engine axis 11 and is connected to the first portion 24 by an out-of-plane curved or bend portion 28. An open end at the downstream end of the second portion 26 forms a pipe outlet 25 (see FIG. 3) of the diffuser pipe 20. Preferably, but not necessarily, the first portion 24 and the second portion 26 of the diffuser pipes 20 are integrally formed together and extend substantially uninterrupted between each other, via the curved, bend portion 28. Referring to FIG. 3, each of the tubular bodies 22 is an enclosed and seamless structure, such that the enclosed flow passage 29 defined by each of the tubular bodies 22 is fluidly separated from the flow passage 29 defined by the other tubular bodies 22. The tubular bodies 22, and thus the diffuser pipes 20, are circumferentially spaced apart from one another about the center axis 11.

The large radial velocity component of the flow exiting the impeller 17, and therefore entering the first portion 24 of each of the diffuser pipes 20, may be removed by shaping the diffuser pipe 20 with the bend portion 28, such that the flow is redirected axially through the second portion 26 before exiting via the pipe outlet 25 to the combustor 16. It will thus be appreciated that the flow exiting the impeller 17 enters the inlet 23 and the upstream first portion 24 and flows along a generally radial first direction. At the outlet of the first portion 24, the flow enters the bend portion 28 which functions to turn the flow from a substantially radial direction to a substantially axial direction. The bend portion 28 may form a 90 degree bend. At the outlet of the bend portion 28, the flow enters the downstream second portion 26 and flows along a substantially axial second direction different from the generally radial first direction. By "generally radial", it is understood that the flow may have axial, radial, and/or circumferential velocity components, but that the axial and circumferential velocity components are much smaller in magnitude than the radial velocity component. Similarly, by "generally axial", it is understood that the flow may have axial, radial, and/or circumferential velocity components, but that the radial and circumferential velocity components are much smaller in magnitude than the axial velocity component.

Referring to FIG. 3, the tubular body 22 of each diffuser pipe 20 has a radially inner wall 22A and a radially outer wall 22B. The tubular body 22 also has a first side wall 22C spaced circumferentially apart across the flow passage 29 from a second side wall 22D. The radially inner and outer walls 22A,22B and the first and second side walls 22C,22D meet and are connected to form the enclosed flow passage 29 extending through the tubular body 22. The radially inner and outer walls 22A,22B and the first and second side walls 22C,22D meet and are connected to form a peripheral edge of the tubular body 22 which circumscribes the pipe outlet 25. The radially inner wall 22A corresponds to the wall of the tubular body 22 that has the smallest turning radius at the bend portion 28, and the radially outer wall 22B corresponds to the wall of the tubular body 22 that has the largest turning radius at the bend portion 28. The tubular body 22 has an outer surface 22E forming an external exposed surface of the diffuser pipe 20, and an inner surface 22F (see FIG. 4) along which fluid flow F moves through the diffuser pipe 20.

The tubular body 22 diverges in the direction of fluid flow F therethrough, in that the internal flow passage 29 defined within the tubular body 22 increases in cross-sectional area between the inlet 23 and the pipe outlet 25 of the tubular body 22. The increase in cross-sectional area of the flow passage 29 through each diffuser pipe 20 is gradual over the length of the diffuser pipe 20. The direction of fluid flow F is along a pipe center axis 21 of the tubular body 22. The pipe center axis 21 extends through each of the first, second, and bend portions 24,26,28 and has the same orientation as these portions. The pipe center axis 21 is thus curved. In an embodiment, the pipe center axis 21 is equidistantly spaced from the radially inner and outer walls 22A,22B of the tubular body 22, and from the first and second side walls 22C,22D, through the tubular body 22.

Still referring to FIG. 3, the tubular body 22 has a length L defined from the inlet 23 to the pipe outlet 25. The length L of the tubular body 22 may be measured based on any desired feature of the diffuser pipe 20. For example, in FIG. 3, the length L is the length of the pipe center axis 21 from the inlet 23 to the pipe outlet 25. In an alternate embodiment, the length L is measured along one of the walls 22A,22B, 22C,22D of the tubular body 22, from the inlet 23 to the pipe outlet 25. Reference may be made herein to positions on the tubular body 22 along its length L. For example, a position on the tubular body 22 that is along a last 10% of the length L is anywhere in the segment of the tubular body 22 that is upstream of the pipe outlet 25 a distance equal to 10% of the length L. This same segment is also downstream of the inlet 23 a distance equal to 90% of the length L. Similarly, a position on the tubular body 22 that is along a first 90% of the length L is anywhere in the segment of the tubular body 22 that is downstream of the inlet 23 a distance equal to 90% of the length L. This same segment is also upstream of the pipe outlet 25 a distance equal to 10% of the length L.

The tubular body 22 is composed of many cross-sectional profiles which are arranged or stacked one against another along the length L of the tubular body 22. Each cross-sectional profile is a planar contour that lies in its own plane that is transverse or normal to the pipe center axis 21. The orientation of the cross-sectional profiles in the frame of reference of the diffuser pipe 20 may vary over the length L of the tubular body 22, depending on where the cross-sectional profiles are located along the pipe center axis 21. Each cross-sectional profile defines the shape, contour, or outline of the tubular body 22 at a specific location along the pipe center axis 21. Referring to FIG. 3, the outlet 25 of each diffuse pipe 20 is positioned radially outwardly of the inlet 23, relative to the center axis 11 of the engine 10. Thus, over its length L, each diffuser pipe 20 extends radially outwardly from the inlet 23. The outlet 25 is spaced radially outwardly from the inlet 23, relative to the center axis 11.

Referring to FIG. 3, the diffuser pipe 20 defines and contains therein a throat 27 located at a point between the inlet 23 and the pipe outlet 25 of the diffuser pipe 20. More particularly, the throat 27 is located in the first portion 24 of the diffuser pipe 20, downstream of the inlet 23 and upstream of the curved portion or bend 28. The precise location of the throat 27 within the first portion 24 can be determined using the measured flow characteristics of the fluid flow F within the diffuser pipe 20, or can correspond to the part of the diffuser pipe 20 having the smallest cross-sectional area. In the former case, the throat 27 is referred to as the "aerodynamic throat", and in the latter case, the throat 27 is referred to as the "geometric throat". It is understood, however, that the aerodynamic throat may not necessarily occur at the same point as the geometric throat. For the geometric throat 27, sometimes referred to as the "neck" of the diffuser pipe 20, each diffuser pipe 20 expands in cross-sectional area along its length from the relatively small cross-sectional area of the geometric throat 27, thereby helping to diffuse the main gas flow as it is conveyed through the diffuser pipe 20.

The location of the aerodynamic throat 27 of the diffuser pipe 20 within the first portion 24 can vary depending on numerous factors such as the flow conditions of the fluid flow F in the diffuser pipe 20, the geometry of the diffuser pipe 20, and the flow conditions upstream and/or downstream of the diffuser pipe 20. For most applications, the location of the aerodynamic throat 27 within the first portion 24 can be suitably approximated for a given range of operating conditions of the compressor section 14 using fluid dynamic analysis, and is approximately the same as the location of the geometric throat 27 within the first portion 24.

Figure 4:
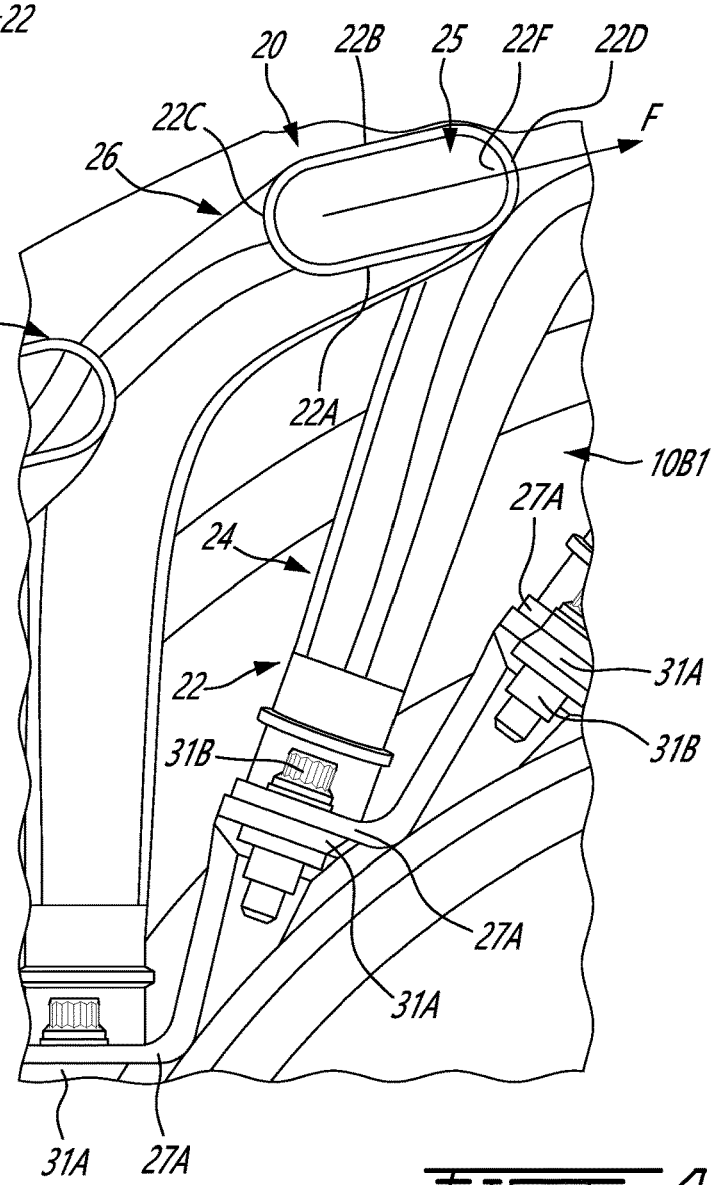
FIG. 4 is a perspective view of some of the diffuser pipes of FIG. 2.

Referring to FIGS. 3 and 4, the diffuser pipe has a flange 27A. The flange 27A is a bracket or mounting extending outwardly from the tubular body 22 in a radial direction from the pipe center axis 21. The flange 27A is used to fixedly mount the tubular body 22 to another structure, such as a corresponding casing flange 31A of the gas generator casing segment 10B1. In the configuration of FIGS. 3 and 4, each diffuser pipe 20 is mounted to the gas generator casing segment 10B1 as follows. The first portion 24 of the tubular body 22 of each diffuser pipe 20 has an end defining the inlet 23, where the end is inserted into a corresponding socket or opening in the gas generator casing segment 10B1 until the flange 27A of the diffuser pipe 20 abuts the casing flange 31A. The tubular body 22 may be rotated about a mounting axis that is collinear with the pipe center axis 21 at the inlet 23. This rotation of the tubular body 22 about the mounting axis helps to align a hole in the flange 27A with a hole in the casing flange 31A. When the holes in the flanges 27A,31A are aligned, a fastener 31B, such as a bolt with a nut, may be inserted through the aligned holes in the flange 27A and the casing flange 31A, and then tightened or torqued to fixedly mount the diffuser pipe 20 to the casing flange 31A. Once the fastener 31B is tightened, the diffuser pipe 20 is mounted to the gas generator casing segment 10B1 and does not move relative to the gas generator casing segment 10B1. Referring to FIGS. 3 and 4, the flange 27A is located in close proximity to the inlet 23 of the diffuser pipe 20. The flange 27A is along the first portion 24 of the tubular body 22, and is positioned adjacent to the inlet 23 and downstream therefrom.

The process of mounting and securing the diffuser pipes 20 to the gas generator casing segment 10B1 may affect how the second, axial portion 26 of the diffuser pipe 20, and the outlet 25 defined by the second portion 26, are oriented. More particularly, the process of mounting and securing the diffuser pipes 20 to the gas generator casing segment 10B1 may affect the orientation of the outlet 25 with respect to other components of the engine 10 which are downstream from the diffuser pipes 20, such as the combustor 16. The fluid flow F exiting the diffuser pipes 20 at the outlet 25 may impinge on the outer surface of the combustor 16. Variations resulting from the assembly of the diffuser pipes 20 with the gas generator casing segment 10B1, and/or during manufacturing of the diffuser pipes 20, may result in the outlets 25 not being uniformly positioned with respect to the combustor 16. This misalignment of the outlets 25 may affect the temperature distribution through the combustor 16. For example, some of the outlets 25 may be oriented such that the fluid flow F exiting these outlets 25 impinges more directly on the outer surface of the combustor 16 than the fluid flow F exiting other outlets 25, such that some portions of the outer surface of the combustor 16 experience more cooling from the impinging fluid flow F than other portions. This effect may cause discrete patterns in the temperature distribution across the combustor 16, which may cause effects downstream of the combustor 16. Thus, the diffuser pipes 20 may have a relatively large variation in the orientation of their outlets 25 based primarily on how they are tightened or secured.

Figure 5:
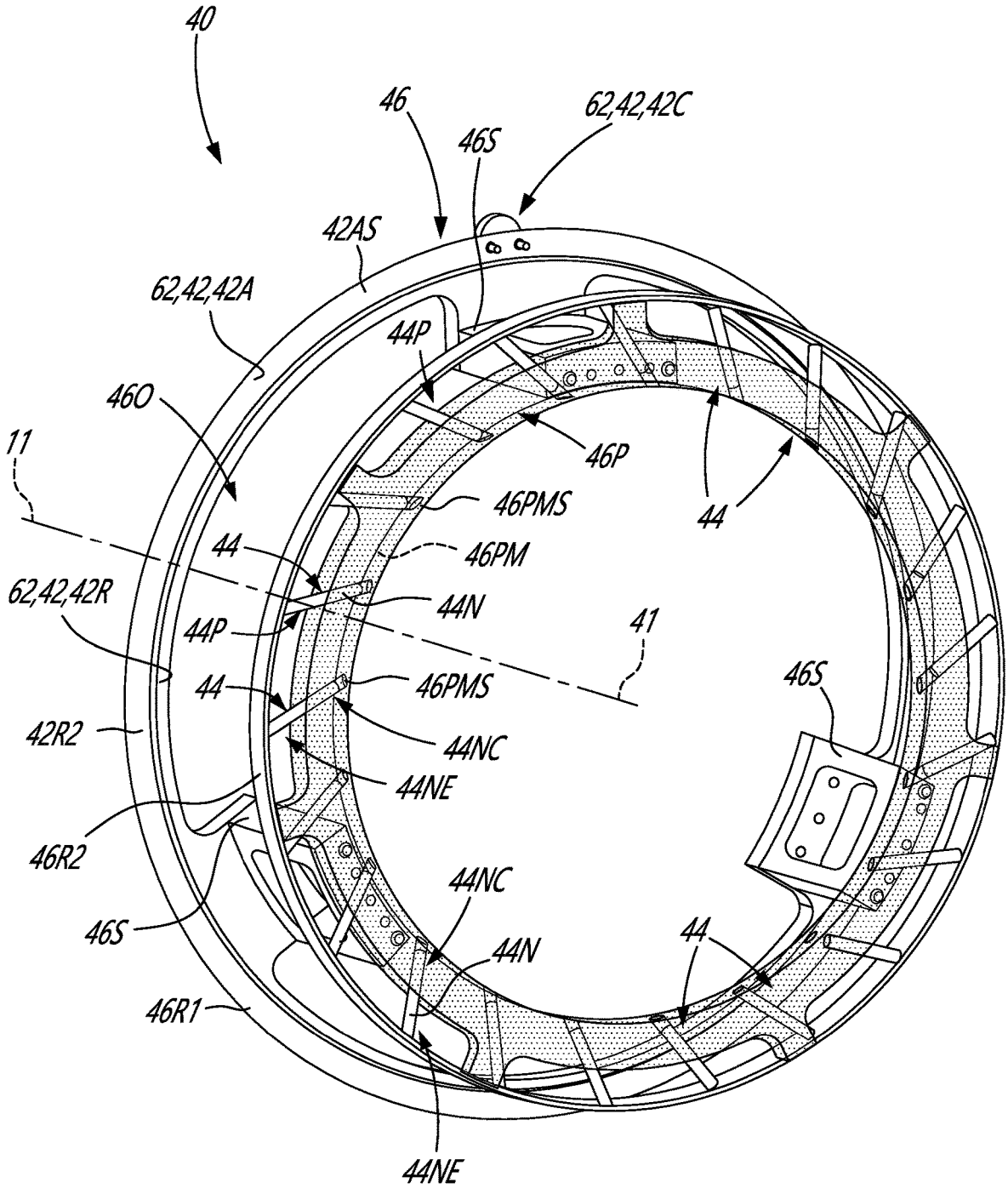
FIG. 5 is a perspective view of an alignment tool.

It may be possible to provide the outlets 25 with a more uniform and consistent orientation across all of the diffuser pipes 20, so as to reduce or avoid the problems described above regarding the distribution of temperature across the combustor 16. Referring to FIG. 5, there is disclosed an alignment tool 40 or feature which may be used to narrow or eliminate the variability in the orientation of the outlets 25 of the diffuser pipes 20. The alignment tool 40 may allow for improved control over the orientation of the outlets 25 of the differ pipes 20, which may improve the temperature distribution across the combustor 16 caused by impinging fluid flow F exiting the diffuser pipes 20. The alignment tool 40 is a device used to facilitate the installation of the diffuser pipes 20. In an embodiment, the alignment tool 40 is a temporary structure that is used to facilitate the installation of the diffuser pipes 20, and which is removed from the engine 10 once the diffuser pipes 20 have been installed and before other components are assembled. In an embodiment, the alignment tool 40 is not a component of the final, assembled engine 10. In an embodiment, and as explained in greater detail below, the alignment tool 40 mimics or replicates portions of a casing segment 10B, e.g. the turbine support casing segment 10B2, to which the gas generator casing segment 10B1 with the diffuser pipes 20 will be mounted. The alignment tool 40 is thus used during assembly of the diffuser pipes 20 to ensure that the outlets 25 of the diffuser pipes 20 are as close as possible to their "nominal" position, i.e. their ideal position assuming that there was no variability resulting from their manufacture or assembly.

Figure 6A:
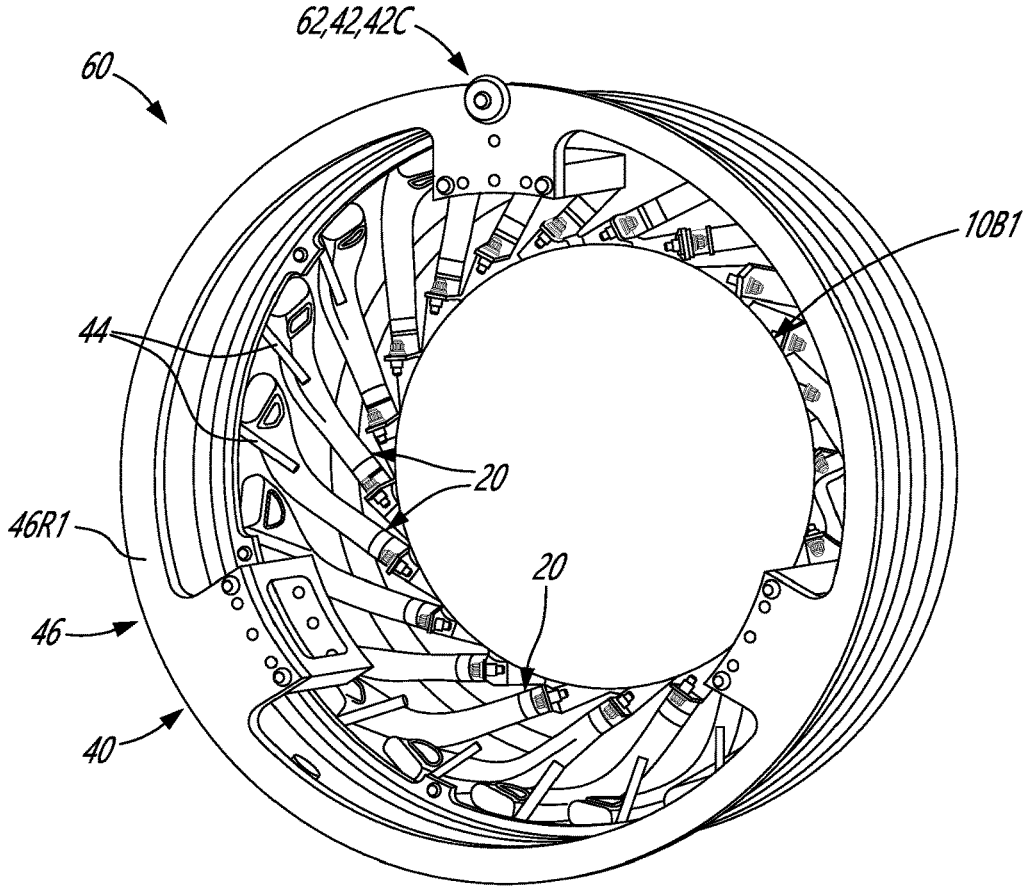
FIG. 6A is a perspective view of the alignment tool of FIG. 5 assembled with a casing of the gas turbine engine of FIG. 1.
Figure 6B:
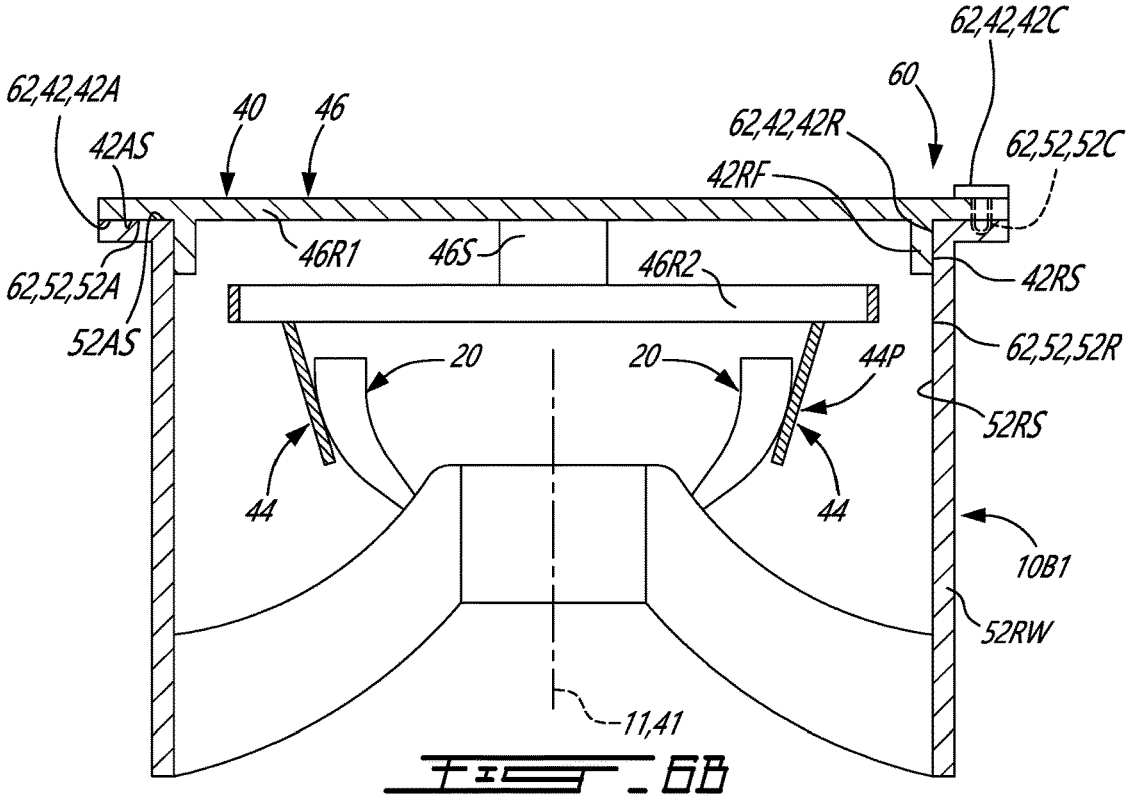
FIG. 6B is a cross-sectional view of the assembled alignment tool and casing of FIG. 6A.

Referring to FIGS. 6A and 6B, the alignment tool 40 is assembled with the gas generator casing segment 10B1 to form an assembly 60. The alignment tool 40 and the gas generator casing segment 10B1 (sometimes referred to herein simply as the "GGC 10B1") are aligned with one another, which allows the diffuser pipes 20 to be secured in their nominal position, as explained in greater detail below. The alignment tool 40 and the GGC 10B1 are aligned along one or more common datum(s) 62 of the assembly 60. The datum(s) 62 are points or portions of one or both of the alignment tool 40 and the GGC 10B1 which serve as references for assembling the alignment tool 40 and the GGC 10B1 in the desired orientation, and for precisely positioning other features of the alignment tool 40 and/or the GGC 10B1 relative to the datum(s) 62. Referring to FIGS. 6A and 6B, the alignment tool 40 and the GGC 10B1 of the assembly 60 are secured together along one or more of the datum(s) 62, as explained in more detail below. In an alternate embodiment, the alignment tool 40 and the GGC 10B1 forming the assembly 60 are not attached to one another. In one example of such an alternate embodiment, the alignment tool 40 sits on the GGC 10B1 such that mating surface(s) defining the datum(s) 62 of the assembly 60 are in frictional contact with one another. In such a configuration, the weight of the alignment tool 40 is sufficient to keep the alignment tool 40 aligned relative to the GGC 10B1 as per the datum(s) 62. In an embodiment, the datum(s) 62 define or form interface(s) along which the alignment tool 40 and the GGC 10B1 are assembled.

One possible arrangement for the datum(s) 62 of the assembly 60 is now described with reference to FIGS. 5 to 6B. Both the alignment tool 40 and the GGC 10B1 have datums 62. More particularly, the alignment tool 40 and the GGC 10B1 have pairs of datums 62, where each pair of datums 62 includes a tool datum 42 of the alignment tool 40 and a casing datum 52 of the GGC 10B1. The datums 62 in each pair interface with each other.

In one example of a pair of datums 62, the tool datum 42 is an axial datum 42A that defines a surface 42AS that extends radially relative to the center axis 11, and the casing datum 52 is an axial datum 52A that defines a surface 52AS that extends radially relative to the center axis 11. The axial datums 42A,52A and their surfaces 42AS,52AS are formed by radially-extending and mating flanges of each of the alignment tool 40 and the GGC 10B1. When the alignment tool 40 and the GGC 10B1 are assembled together, the flanges and their axial datums 42A,52A abut one another (see FIG. 6B), such that the surfaces 42AS,52AS are brought into mating contact. This engagement between the pair of axial datums 42A,52A prevents relative movement between the alignment tool 40 and the GGC 10B1 in a direction that is parallel to the center axis 11, thereby ensuring that the alignment tool 40 and the GGC 10B1 are "axially" aligned because their axial position is controlled. Each of the surfaces 42AS,52AS lies in a plane that is perpendicular to the center axis 11, and that is annular about the center axis 11.

In another example of a pair of datums 62, and referring to FIGS. 5 to 6B, the tool datum 42 is a radial datum 42R that defines a surface 42RS that extends annularly about the center axis 11, and the casing datum 52 is a radial datum 52R that defines a surface 52RS that extends annularly about the center axis 11. The radial datum 42R and the surface 42RS of the alignment tool 40 are formed by an axially-extending annular flange 42RF. The flange 42RF extends perpendicularly relative to the flange defining the axial datum 42A of the alignment tool 40. The radial datum 52R and the surface 52RS of the GGC 10B1 are formed by the radially-inner surface of an annular and axially-extending wall 52RW of the GGC 10B1. When the alignment tool 40 and the GGC 10B1 are assembled together, the flange 42RF and the wall 52RW abut one another, such that the surfaces 42RS,52RS are brought into mating contact. This engagement between the pair of radial datums 42R,52R prevents relative movement between the alignment tool 40 and the GGC 10B1 in a direction that is radial to the center axis 11, thereby ensuring that the alignment tool 40 and the GGC 10B1 are "radially" aligned because their radial position is controlled. The surfaces 42RS,52RS may be in tight-fit or low tolerance mating contact, such that the frictional engagement between the surfaces 42RS,52RS reduces or prevents relative circumferential movement between the alignment tool 40 and the GGC 10B1 in a direction about the center axis 11. Each of the surfaces 42RS,52RS lies in a curved plane that is annular about the center axis 11.

Relative circumferential movement between the alignment tool 40 and the GGC 10B1 may be further reduced or prevented with another example of a pair of datums 62. Referring to FIGS. 5 to 6B, the tool datum 42 is a circumferential datum 42C, and the casing datum 52 is a circumferential datum 52C. The circumferential datums 42C,52C may take different forms. For example, and referring to FIGS. 5 to 6B, the tool circumferential datum 42C includes a knob, such as a timing knob, that has or rotates an axially-extending threaded shaft. The threaded shaft is insertable into an axially-extending threaded groove of the casing circumferential datum 52C. The knob may be rotated to torque the threaded shaft within the threaded groove, and thereby abut the mating flanges of the axial datums 42A,42B together, which also secures the alignment tool 40 to the GGC 10B1. Other configurations of the circumferential datums 42C,52C are possible. This engagement between the pair of circumferential datums 42C,52C prevents relative movement between the alignment tool 40 and the GGC 10B1 in a direction that is circumferential or tangential about the center axis 11, thereby ensuring that the alignment tool 40 and the GGC 10B1 are "circumferentially" aligned because their circumferential position is controlled. The circumferential datums 42C,52C may be said to control "timing", also understood to be the relative angular position between the alignment tool 40 and the GGC 10B1. The tool circumferential datum 42C may thus be mounted to the GGC 10B1 in order to mount the alignment tool 40 to the GGC 10B1. Thus, and referring to FIGS. 5 to 6B, the alignment tool 40 and the GGC 10B1 are secured together along only one of the datums 62 of the assembly 60 (e.g. the circumferential datums 42C,52C), which may facilitate assembly and disassembly of the alignment tool 40 and the GGC 10B1. In an alternate embodiment, the alignment tool 40 and the GGC 10B1 are secured together along two or more of the datums 62 of the assembly 60. In an alternate embodiment, the alignment tool 40 and the GGC 10B1 abut along only one pair of datums 62, such that the axial, radial and circumferential/angular positions of the alignment tool 40 and the GGC 10B1 are controlled along only one common datum 62.

Referring to FIGS. 5 to 6B, the alignment tool 40 has a plurality of alignment members 44. The alignment members 44 are objects or features of the alignment tool 40 which may help to narrow or eliminate the variability in the orientation of the outlets 25 of the diffuser pipes 20. The alignment members 44 may allow for improved control over the orientation of the outlets 25 of the differ pipes 20, which may improve the temperature distribution across the combustor 16 caused by impinging fluid flow F exiting the diffuser pipes 20. Each of the alignment members 44 has a fixed position relative to the common datum(s) 62 of the assembly 60. Each of the alignment members 44 has a fixed position relative to the tool datum(s) 42 of the alignment tool 40. By "fixed position", it is understood that the alignment members 44 are positioned on the alignment tool 40 such that the position (e.g. distance, orientation, etc.) of the alignment members 44 relative to the tool datum(s) 42 is known and may be predefined. Referring to FIGS. 5 to 6B, the fixed position of the alignment members 44 is achieved by mounting or securing the alignment members 44 at specific locations of the alignment tool 40. In an alternate embodiment, the alignment tool 40 has a plurality of different pre-set locations for each alignment member 44 defined by bosses, apertures or the like, such that each alignment member 44 can be fixable in a pre-set position, where each pre-set position corresponds to a location of the diffuser pipes in a given configuration of the engine 10 and/or compressor diffuser 20A. The alignment members 44 are thus tightly controlled relative to the primary, secondary and tertiary tool datums 42 of the alignment tool 40 which interface with the primary, secondary and tertiary casing datums 52 of the GGC 10B1. This indexing helps the alignment tool 40 to mimic the installation of the GGC 10B1 with adjacent components of the engine 10, such as the combustion liner and turbine support casing segment 10B2, since these components interface relative to the same casing datums 52.

Referring to FIGS. 5 to 6B, each of the alignment members 44 has a portion 44P that extends radially inwardly toward the center axis 11. The portion 44P extends along a direction defined by a directional vector including a component vector that is radial relative to the center axis 11. The portion 44P may be aligned relative to a center axis 41 of the alignment tool 40. The center axis 41 is collinear with the center axis 11 when the alignment tool 40 is indexed to the GGC 10B1. In an embodiment, the portion 44P of the alignment member 44 is all of the alignment member 44. In an alternate embodiment, the portion 44P of the alignment member 44 is less than all of the alignment member 44.

The alignment tool 40 and the alignment members 44 may have different configurations. One possible configuration of the alignment tool 40 is shown in FIGS. 5 to 6B. The alignment tool 40 has a body 46 that forms the corpus of the alignment tool 40 and provides structure thereto. The body 46 is annular about the center axis 41 of the alignment tool 40. In the illustrated embodiment, the body 46 includes a first ring 46R1 circumscribing an opening 460 of the body 46, and a second ring 46R2. The second ring 46R2 is spaced apart from the first ring 46R1 in a direction that is parallel to the center axis 41. The diameter of the second ring 46R2 is less than the diameter of the first ring 46R1. The first and second rings 46R1,46R2 are interconnected by one or more spacer(s) 46S of the body 46. The spacer(s) 46S are axially-extending brackets or fasteners that secure the first and second rings 46R1,46R2 together and prevent relative movement between the first and second rings 46R1,46R2. In the illustrated embodiment, the body 46 has three spacers 46S that are circumferentially spaced apart from each other about the center axis 41. Each of the spacers 46S are blocks having a central opening and extending axially relative to the center axis 41. Other configurations for the spacers 46S are possible. In an alternate embodiment, the body 46 has a rectangular or other polygonal shape.

Referring to FIGS. 5 to 6B, the alignment members 44 are mounted to the second ring 46R2 and are circumferentially spaced apart about the center axis 41. This positioning of the alignment members 44 allows their portions 44P to extend radially inwardly from the second ring 46R2 toward the center axis 41. Referring to FIG. 5, in addition to having a radial directional vector, the portion 44P may have a tangential/circumferential and/or axial directional vectors, such that one or more of the portions 44P has an orientation defined by a directional vector that has non-zero radial, axial and circumferential components relative to the center axis 41. In an embodiment, the magnitude of the radial component is larger than the magnitude of the axial and circumferential components, such that that portions 44P are substantially radially-protruding bodies.

Referring to FIGS. 5 to 6B, the alignment members 44 are mounted to, or supported by, a support 46P of the body 46. The support 46P maintains the alignment members 44 in their desired orientation relative to the center axis 41 and prevents them from moving relative to the body 46 or its features. The support 46P maintains the alignment members 44 in their desired orientation relative to the tool datum(s) 42 and prevents them from moving relative to the tool datum(s) 42. The support 46P may take any configuration to achieve this functionality. For example, and referring to FIGS. 5 to 6B, the support 46P is an object that is annular about the center axis 41, and the alignment members 44 are circumferentially spaced apart and mounted to/supported by the support 46P. Referring to FIG. 5, the support 46P is formed by, or includes, a mesh 46PM. The mesh 46PM is fixedly secured to the second ring 46R2 and extends radially inwardly toward the center axis 41 from the second ring 46R2. The mesh 46PM includes openings and slots 46PMS into which the alignment members 44 may be inserted so that the mesh 46PM can support the alignment members 44. The slots 46PMS are circumferentially spaced apart from each other about the center axis 41. The slots 46PMS are also indexed to the tool datum(s) 42 so that they, and thus the alignment members 44 received in the slots 46PMS, have the desired orientation. The alignment members 44 are encased in the mesh 46PM. The alignment members 44 are immobilized by the mesh 46PM and do not move relative to the mesh 46PM. The mesh 46PM serves as a support for the alignment members 44 and has a low weight, which may facilitate manipulation of the alignment tool 40. The mesh 46PM may be made of a lightweight material, such as plastic. In an embodiment, the alignment tool 40 is lowered toward the GGC 10B1 to form the assembly 60, such that the GGC 10B1 is below the alignment tool 40 in the assembly 60. In such an embodiment, the mesh 46PM supports the alignment members 44 and prevents them from falling down into the GGC 10B1. The support 46P for the alignment members 44 may have other configurations as well. For example, in an alternate embodiment, the support 46P is a ring or annular body to which the alignment members 44 are fixedly mounted.

One possible and non-limiting configuration for the support 46P and the alignment members 44 is now described with reference to FIG. 5. The alignment members 44 are elongated cylindrical bodies. The alignment members 44 are pins 44N that are circumferentially spaced apart about the center axis 41. In an embodiment, the pins 44N are hollow. In an embodiment, the pins 44N are solid bodies. The pins 44N may be made from any suitable material, such as metal, composites or plastics. The alignment members 44 are tubular and extend along a longitudinal axis. The pins 44N are inserted into the slots 46PMS of the mesh 46PM so that the mesh 46PM houses the pins 44N. Referring to FIG. 5, an exposed segment 44NE of each pin 44N extends out of the mesh 46PM, and a covered segment 44NC of each pin 44N is housed in one of the slots 46PMS of the mesh 46PM. Thus, part of the pins 44N (i.e. the covered segments 44NC) is prevented from impacting and potentially damaging the GGC 10B1 in the configuration where the alignment tool 40 is lowered toward the GGC 10B1. Another part of the pins 44N (i.e. the expose segments 44NE) form the parts 44P of the alignment members 44 that abut against the diffuser pipes 20. Other shapes for the alignment members 44 are possible. For example, the alignment members 44 may be cuboid, polyhedron, etc.

Other configurations for the support 46P and the alignment members 44 are possible. For example, in another possible configuration for the support 46P and the alignment members 44, the support 46P is a ring or annular body with slots into which the pins 44N are threaded or otherwise secured. In yet another possible configuration, the alignment members 44 are grooves which are circumferentially spaced apart and which extend radially into an annular support 46P, or into the second ring 46R2, or into the first ring 46R1. In yet another possible configuration, the alignment members 44 are plates or other planar bodies which extend radially inwardly from an annular support 46P, or from the second ring 46R2, or from the first ring 46R1. In yet another possible configuration, the alignment members 44 are bumps which are circumferentially spaced apart and which extend radially outwardly from an annular support 46P, or from the second ring 46R2, or from the first ring 46R1. Other configurations are also possible. The alignment members 44 may be made, secured and/or indexed to the tool datum(s) 42 by any method including a fabricated assembly, being machined from solid material, additive manufacturing with subsequent machining, etc.

The alignment members 44 help to narrow or eliminate the variability in the orientation of the outlets 25 of the diffuser pipes 20. Referring to FIGS. 5 to 6B, when the assembly 60 of the alignment tool 40 and GGC 10B1 is formed and it is desired to orient or align the diffuser pipes 20, some or all of each diffuser pipe 20 abuts against some or all of the portion 44P of each alignment member 44 so that the diffuser pipes 20 can achieve their desired orientation. By indexing the portions 44P of the alignment members 44 to the tool datum(s) 42 and then allowing the diffuser pipes 20 to abut against the indexed portions 44P, the diffuser pipes 20 (and their outlets 25/pipe exits in one particular embodiment described below) are able to obtain the desired and accurate final orientation. The diffuser pipes 20 can be secured in their desired orientation by tightening the fastener 31B while the diffuser pipes 20 remain abutted against the alignment members 44, and thus while the diffuser pipes 20 remain indexed to the common datum(s) 62 of the assembly 60. The diffuser pipes 20 (and/or their outlets 25/exits, as described below) may thus be aligned relative to the casing datums 52 of the GGC 10B1. The alignment tool 40 and its alignment members 44 thus allow for aligning each individual diffuser pipe 20 to a common engine assembly flange (e.g. the flange of the GGC 10B1 that defines the casing axial datum 52A), and thus for aligning each individual diffuser pipe 20 to the center axis 11 of the engine 10.

Figure 7:
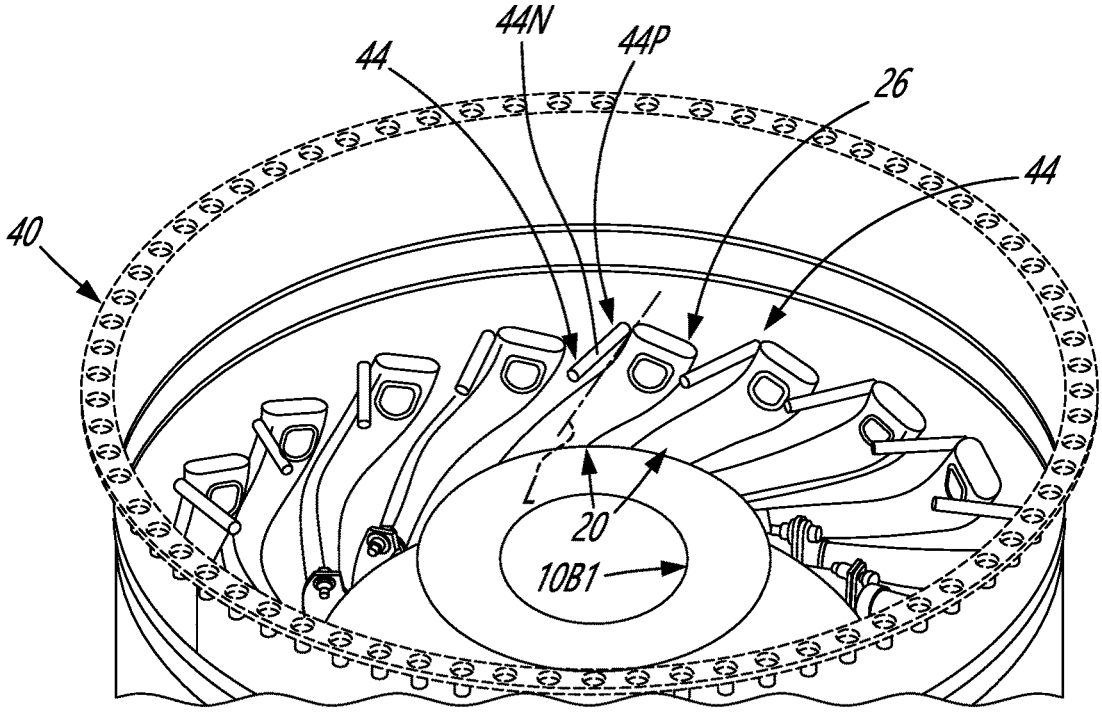
FIG. 7 is a perspective view of the assembled alignment tool and casing of FIG. 6A.
Figure 8:
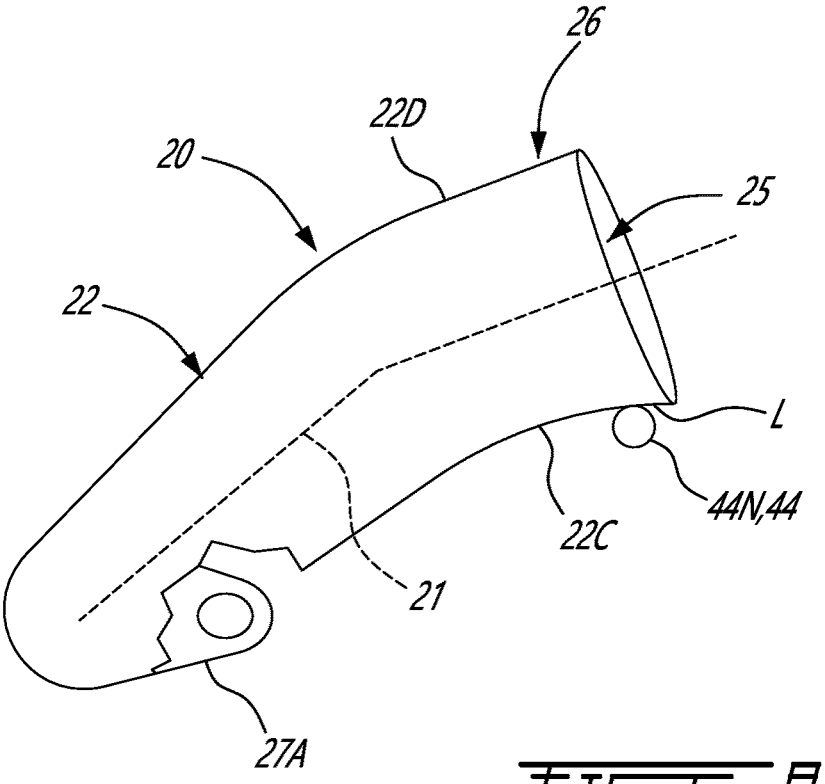
FIG. 8 is a view of one of the diffuser pipes of FIG. 2.

In an embodiment, the alignment tool 40 and its alignment members 44 allow for aligning the outlets 25 of the diffuser pipes 20. Referring to FIGS. 7 and 8, the portion of each diffuser pipe 20 which is abutted against portion 44P of a corresponding alignment member 44 is the segment of the tubular body 22 which defines the outlet 25. Referring to FIGS. 7 and 8, the second portion 26 of the tubular body 22, which defines the outlet 25 of each diffuser pipe 20, abuts the portion 44P of each alignment member 44. Thus, the diffuser pipe 20 may be manipulated to abut the segments of the tubular body 22 which define the outlet 25 against the alignment members 44. Thus, by indexing the portions 44P of the alignment members 44 to the tool datum(s) 42 and then allowing the exit segments of the diffuser pipes 20 to abut against the indexed portions 44P, the outlets 25 of the diffuser pipes 20 are able to obtain the desired and accurate final orientation. The exit or outlet 25 (the terms are used interchangeably herein) of each diffuser pipe 20 may be controlled in this manner so that exits of the diffuser pipes 20 have an orientation as close to nominal as possible. The alignment tool 40 and its alignment members 44 thus allow the abutted exits of the diffuser pipes 20 to have a substantially uniform orientation. In an embodiment, the orientation of each outlet 25 is defined by plane at the opening forming the outlet 25, where the plane is normal to the pipe center axis 21. The orientation of the planes at each of the outlets 25 may be defined within the coordinate system of the GGC 10B1 and/or of the engine 10. The orientation of the planes at each of the outlets 25 may be made uniform or the same in this coordinate system with the alignment tool 40, within acceptable tolerances. By helping to make the orientation of the outlets 25 more uniform, the alignment tool 40 may help to reduce or eliminate the misalignment of the outlets 25. This may cause the fluid flow F exiting the diffuser pipes 20 to more uniformly impinge upon the combustor 16, and thus may help to reduce or eliminate discrete patterns in the temperature distribution across the combustor 16.

In an embodiment, the alignment tool 40 was able to reduce variability in the orientation of the exit of the diffuser pipe 20 that is caused when the diffuser pipe 20 is rotatably mounted to the GGC 10B1. It has been observed that the alignment tool 40 may reduce variability in the orientation of the outlet 25 to ±0.010 in. or ±0.2°, meaning that the orientation of the outlet 25 of one diffuser pipe 20 might vary slightly from the orientation of the outlet 25 of another diffuser pipe 20 by ±0.010 in. or ±0.2°. It will thus be appreciated that statements made herein that the outlets 25 of the diffuser pipes 20 have the "same" orientation, are "aligned", and/or are "uniform", are understood to include minor variations in the orientation caused when mounting the diffuser pipes 20 to the GGC 10B1. The reduced variability in the orientation of the outlets 25 to ±0.010 in. or ±0.2° may be an improvement of about 93% over another technique for mounting the diffuser pipe 20 to the GGC 10B1, in which the variability in the orientation of the outlet 25 was observed to be ±0.150 in. or ±3°.

Referring to FIG. 7, each alignment member 44 is positioned circumferentially between two diffuser pipes 20. Each alignment member 44 is positioned circumferentially between a pair of the diffuser pipes 20. Each diffuser pipe 20 is positioned circumferentially between a pair of the alignment members 44. Each of the diffuser pipes 20 abuts only one of the alignment members 44. Referring to FIG. 7, the number of pins 44N is equal to the number of diffuser pipes 20. Referring to FIG. 7, the alignment tool 40 has twenty-one pins 44N, and the GGC 10B1 has twenty-one diffuser pipes 20. More or fewer pines 44N and diffuser pipes 20 are possible. In an alternate embodiment, each diffuser pipe 20 abuts against two alignment members 44.

In an embodiment, and referring to FIGS. 7 and 8, the segment of the diffuser pipes 20 defining the pipe outlet 25 abuts against the portion 44P of each alignment member 44 along a line of contact L. The line of contact L is formed at the location where the exit segment of the diffuser pipe 20 abuts the portion 44P. The line of contact L has a length defined as the length along which the diffuser pipe 20 abuts against the portion 44P. In FIG. 8, the line of contact L extends into and out of the page. The line of contact L may be a tangent to the curved surface of the pine 44N and/or to the outer surface of the second portion 26 of the tubular body 22. In an embodiment, the line of contact L is a tangent to a point on one of the curved first and second side walls 22C,22D of the tubular body 22. Referring to FIGS. 7 and 8, the line of contact L has an orientation parallel to the pin 44N. Referring to FIGS. 7 and 8, the line of contact L is adjacent to the outlet 25. Referring to FIGS. 7 and 8, the line of contact L is formed on the second portion 26 of the tubular body 22. The alignment tool 40 thus allows for the outlets 25 of the diffuser pipes 20 to be aligned as close to nominal via the lines of contact L defined by the diffuser pipes 20 abutted to the alignment member 44. Referring to FIG. 8, the line of contact L is selected to be formed at a known location on the tubular body 22 where two halves of sheet metal meet to form the tubular body 22. The line of contact L may be formed elsewhere on the tubular body 22, such as along an outer surface of the first or bend portions 24,28. In an alternate embodiment, the line of contact L is defined by abutting a diffuser pipe 20 against a non-cylindrical alignment member 44, such as a planar body. In an alternate embodiment, the line of contact L is a discrete point of contact formed at the location where the exit segment of the diffuser pipe 20 abuts the portion 44P. In an alternate embodiment, the line of contact L is a plane of contact formed at the location where the exit segment of the diffuser pipe 20 abuts the portion 44P. The alignment members 44 and/or their portions 44P may have any suitable shape which results in the line of contact L being formed with the diffuser pipe 20, such shapes including but not limited to cylindrical, cuboid, polyhedron, etc.

Figure 9:
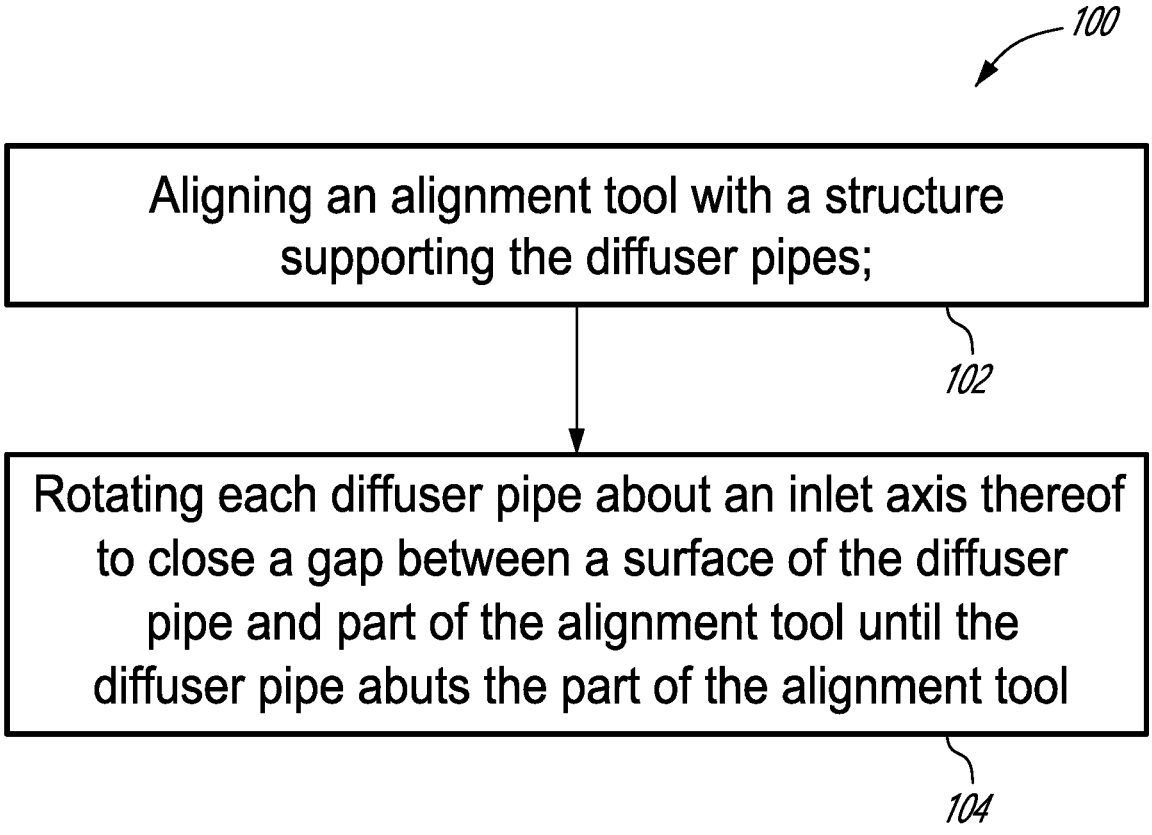
FIG. 9 is an example flow chart of a method of aligning diffuser pipes.

Referring to FIG. 9, there is disclosed a method 100 of aligning the diffuser pipes 20. At 102, the method 100 includes aligning the alignment tool 40 with a structure (e.g. the GGC 10B1) supporting the diffuser pipes 20. This may include indexing the alignment tool 40 to the structure, by manipulating the alignment tool 40 so that its orientation with respect to the structure is held fixed. At 104, the method 100 includes displacing one of the structure and the diffuser pipes 20 relative to the alignment tool 40 until the diffuser pipes 20 abut against parts of the alignment tool 40. This may include rotating the diffuser pies 20 about their mounting axis until their exit segments abut against the portions 44P of the alignment members 44. In an alternate embodiment, the alignment tool 40 may be aligned with the GGC 10B1 but not secured thereto, such that the GGC 10B1 is rotated relative to the alignment tool 40 about the center axis 11 in order to rotate the diffuser pipes 20 so that they abut the alignment members 44. In an alternate embodiment, the alignment tool 40 may be aligned with the GGC 10B1 but not secured thereto, such that the alignment tool 40 may be rotated relative to the GGC 10B1 about the center axis 11 in order to abut the alignment members 44 against the diffuser pipes 20. In an alternate embodiment, the casing datums 52 and the tool datums 42 are indexed along two degrees of freedom, and free to rotate relative to one another along a third circumferential degree of freedom to bring the alignment members 44 into contact with the diffuser pipes 20.

Referring to FIGS. 5 to 6B, the alignment tool 40 and the GGC 10B1 may be aligned and the diffuser pipes 20 installed as follows. First, the diffuser pipes 20 are installed on the casing flanges 31A of the GGC 10B1 one at a time. The first portion 24 of each diffuser pipe 20 is inserted into a corresponding socket of the casing flange 31A, and the tubular body 22 is rotated about the mounting axis (e.g. in a counter clockwise rotation direction away from casing flange 31A) until the holes of the flanges 27A,31A are aligned. The fastener 31B is inserted through the aligned holes and hand tightened. This process if repeated for all of the diffuser pipes 20. Second, the alignment tool 40 is installed against the GGC 10B1 by aligning the datum(s) 62 and forming the assembly 60. The alignment tool 40 may be lowered toward the GGC 10B1 to abut the tool datum(s) 42 against the corresponding casing datum(s) 52. Thus, in an embodiment, the diffuser pipes 20 are mounted to the GGC 10B1 before the assembly 60 is formed. In an embodiment, the alignment tool 40 is secured to the GGC 10B1 along their circumferential datums 42C,52C.

Third, the diffuser pipes 20 are abutted against alignment members 44 one at a time. The tubular body 22 of each diffuser pipe 20 is rotated about the mounting axis (clockwise, for example) until a portion of the tubular body 22, such as the exit segment defining the outlet 25, abuts against, or makes contact with, the portion 44P of the alignment member 44. The alignment members 44 thus restrict or limit rotation of the diffuser pipes 20 about the mounting axis in one rotational direction, such that contact with the alignment members 44 indicates that the diffuser pipe 20 is the nominal position. The tubular bodies 22 may each be rotated until they form the line of contact L with the portion 44P of the alignment member 44, such that line of contact L serves to control the position of the outlets 25. Each tubular body 22 may be rotated until only the exposed segment 44NE of the corresponding alignment member 44 abuts against the exit segment of the diffuser pipe 20, the remaining covered segment 44NC of the alignment member 44 being housed in the mesh 46PM. Fourth, while the diffuser pipe 20 remains abutted against the alignment member 44, the fastener 31B is torqued to bolt the diffuser pipe 20 to the GGC 10B1, such that the diffuser pipe 20 (and its outlet 25) is in the nominal position relative to the casing datums 52 of the GGC 10B1. The outlets 25 of the abutted diffuser pipes 20 have uniform orientations, helping to ensure that all of the exits of the diffuser pipes 20 are aligned (e.g. the outlets 25 replicate nominal position +/−0.010"). This process is repeated for all diffuser pipes 20, such that the process involves individually aligning the diffuser pipes 20 prior to bolting them down. Aligning the individual diffuser pipes 20 relative to casing datums 52 prior to bolting down may allow for easy separation of the assembly 60 for quick adjustments and individual diffuser pipe 20 replacement. Fifth, once all the fasteners 31B are torqued, the alignment tool 40 is removed, leaving the diffuser pipes 20 installed and aligned on the GGC 10B1.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, although the alignment tool 40 is described herein as being used during assembly of the diffuser pipes 20, it may be used to assist with aligning other objects or components. For example, the processes described herein related to the use of the alignment tool 40 may be performed during a repair or retrofit of an existing engine 10, in addition to during assembly of a new engine. Yet further modifications could be implemented by a person of ordinary skill in the art in view of the present disclosure, which modifications would be within the scope of the present technology.

The invention claimed is:

1. A method of positioning exits of diffuser pipes of a centrifugal compressor in an aircraft engine,
the method comprising:
aligning an alignment tool with a structure supporting the diffuser pipes; and
rotating each said diffuser pipes about an inlet axis thereof to close a gap between a surface of the diffuser pipe and part of the alignment tool until the diffuser pipe abuts the part of the alignment tool.

2. The method of claim 1,
wherein rotating each said diffuser pipe includes rotating each said diffuser pipe to abut an exit segment against the part of the alignment tool,
the exits of the abutted diffuser pipes having uniform orientations.

3. The method of claim 1,
wherein rotating each said diffuser pipe includes rotating each said diffuser pipe one at a time.

4. The method of claim 1,
comprising fixing each said diffuser pipe in position after abutting each said diffuser pipe against the part of the alignment tool.

5. The method of claim 4, comprising removing the alignment tool from the structure.

6. The method of claim 1, comprising mounting the diffuser pipes to the support structure before aligning the alignment tool with the structure.

7. The method of claim 1,
wherein rotating each said diffuser pipe includes rotating each said diffuser pipe to abut the diffuser pipe against the part of the alignment tool and to provide exit segments of the diffuser pipes with uniform orientations relative to a downstream combustor.

8. The method of claim 1, comprising mounting the diffuser pipes to the support structure before aligning the alignment tool with the structure, wherein aligning the alignment tool with the structure includes lowering the alignment tool against the support structure.

9. The method of claim 1, wherein aligning the alignment tool with the structure includes abutting the alignment tool and the structure along at least one common datum.

10. The method of claim 9, wherein abutting the alignment tool and the structure along at least one common datum includes abutting the alignment tool and the structure together to prevent relative movement along at least one of an axial direction, a radial direction, and a circumferential direction.

11. The method of claim 1, wherein aligning the alignment tool with the structure includes mounting the alignment tool to the structure along at least one common datum.

12. The method of claim 1, wherein rotating each said diffuser pipe includes rotating each said diffuser pipe (20, FIG. 6B) to abut the diffuser pipe against the part of the alignment tool (40, FIG. 6B) along a line of contact.

* * * * *